US006817698B2

(12) United States Patent
Verlinden et al.

(10) Patent No.: US 6,817,698 B2
(45) Date of Patent: Nov. 16, 2004

(54) DROPLET DEPOSITION APPARATUS WITH RELEASABLY ATTACHED NOZZLE PLATE

(75) Inventors: Bart Verlinden, Tongeren (BE); Bart Verhoest, Niel (BE)

(73) Assignee: Agfa-Gevaert, Mortsel (BE)

( * ) Notice: Subject to any disclaimer, the term of this patent is extended or adjusted under 35 U.S.C. 154(b) by 74 days.

(21) Appl. No.: 10/333,969

(22) PCT Filed: Jul. 31, 2001

(86) PCT No.: PCT/EP01/08890

§ 371 (c)(1),
(2), (4) Date: Jan. 23, 2003

(87) PCT Pub. No.: WO02/09943

PCT Pub. Date: Feb. 7, 2002

(65) Prior Publication Data

US 2004/0021729 A1 Feb. 5, 2004

Related U.S. Application Data

(60) Provisional application No. 60/231,921, filed on Nov. 9, 2000.

(30) Foreign Application Priority Data

Aug. 1, 2000 (EP) ..... 00202739

(51) Int. Cl.[7] ..... B41J 2/14; B41J 2/16

(52) U.S. Cl. ..... 347/47; 347/49

(58) Field of Search ..... 347/44, 47, 49

(56) References Cited

U.S. PATENT DOCUMENTS 5,563,641 A * 10/1996 Plesinger ..... 347/47
6,232,135 B1 * 5/2001 Ashe et al. ..... 438/21

* cited by examiner

*Primary Examiner*—Michael S. Brooke
(74) *Attorney, Agent, or Firm*—John A. Merecki; Hoffman, Warnick & D'Alessandro

(57) ABSTRACT

A multi-channel droplet deposition apparatus including a body (103) having a plurality of channels (104*a*) terminating in a common channel termination surface (104) and a nozzle plate (102) having nozzles (102*a*) for selectively ejecting liquid drops originating from the channels, wherein the nozzle plate is releasably attached to the body by an adhesive layer.

10 Claims, 3 Drawing Sheets

DROPLET DEPOSITION APPARATUS WITH RELEASABLY ATTACHED NOZZLE PLATE

This application claims benefit of 60/231,021 filed Nov. 9, 2000.

FIELD OF THE INVENTION

This invention relates to droplet deposition apparatus and especially to ink jet printheads. In particular it relates to methods for attaching the nozzle plate to the printhead body.

BACKGROUND OF THE INVENTION

It is known in the art of ink jet printing that problems with uneven printing, white lines, etc. can occur and that the cause of such printing defect resides frequently in the nozzles through which the ink droplets are propelled towards the ink receiving medium. The printing defects mentioned above can be caused by clogged nozzles, e.g., by drying of the ink in the nozzle or by impurities in the ink, by damaged nozzles, e.g., by the presence of hard pigments in the ink.

In SOHO (Small Office/Home Office) printers, when problems arise the printhead is discarded in its entirety and replaced. In larger ink jet printers larger printheads, even page wide printheads are used. A typical example of such a printhead has been disclosed in U.S. Pat. No. 5,855,713. This patent discloses a printhead with a body with a plurality of parallel channels therein, the channels terminating in a common channel termination plane and a nozzle plate mounted on the body at the channel termination plane. The body and the nozzle plate are firmly bound together so that when printing problems arise due to defects in the nozzles, the whole printhead has to be discarded, or else the rework in removing the nozzle plate and replacing it with a new one is a very cumbersome task. In printhead structures as described above the nozzle plate represents less than 20% of the cost price of the printhead. Thus, the user is almost forced to discard an expensive printhead of the printer because a fairly inexpensive part of it has a defect.

EP-A-0 703 082 discloses a printer wherein a nozzle plate is releasably attached to the printhead body by a clamp.

In JP-A-55 121081, a nozzle plate is releasably attached to the printhead body by means of a guide rail.

JP-A-63 064755 discloses nozzle plates that each have only a single nozzle; the nozzle plates are releasably attached to the printhead body by means of protrusions and grooves.

There is still need for an improved releasably attached nozzle plate.

OBJECTS AND SUMMARY OF THE INVENTION

It is an object of the invention to provide a droplet deposition apparatus comprising a nozzle plate that can easily be interchanged.

The above mentioned object is realized by a droplet deposition apparatus in accordance with the invention as claimed in claim 1. The dependent claims set out preferred embodiments of the invention.

In accordance with the invention, a nozzle plate is releasably attached to the printhead body by using an adhesive layer so that upon detaching the nozzle plate from the channel termination surface, there is an adhesive break between the adhesive layer and the channel termination surface and there is no cohesive break within the adhesive layer. An important advantage of the invention is that upon peeling by a shear force the nozzle plate is removed from the printhead body together with the adhesive layer. No or only a negligible residue of adhesive remains on the printhead body. Thus, if the nozzle plate has a defect, it is easy to remove the nozzle plate and the adhesive layer and to attach a new nozzle plate to the printhead body, thus reusing the printhead body.

BRIEF DESCRIPTION OF THE DRAWINGS

The invention is described with reference to the following drawings without the intention to limit the invention thereto, and in which.

DETAILED DESCRIPTION OF THE INVENTION

We have found that, in a multi-channel droplet deposition apparatus—especially in an ink-jet printhead—comprising a body with a plurality of channels terminating in a common channel termination surface and a nozzle plate with through holes placed on said body at said termination surface, it is possible to attach a nozzle plate releasably to the body without having said nozzle plate moving during the operation of the printer, so that the distance nozzle plate/ink receiving medium stays constant and the registering between the nozzle plate and the channels is not diminished. This is even so in printhead structures wherein the outlet of the channel is larger than the opening of the nozzle and where thus, when the ink is propelled through the nozzles by piezo forces, the ink exerts pressure against the nozzle plate.

First, four embodiments in accordance with the invention will be described that have different mechanical configurations. In the first and second embodiments, the nozzle plate 102 is attached to a frame 101 that is attached to the printhead body 103. In the third embodiment, so-called "mini nozzle plates" are used. In the fourth embodiment, no frame 101 is used to carry the nozzle plate 102.

Then, it will be described how a nozzle plate is releasably attached in accordance with the invention, i.e. by using an adhesive layer so that upon detaching the nozzle plate from the channel termination surface, there is an adhesive break between the adhesive layer and the channel termination surface.

Figure 1:
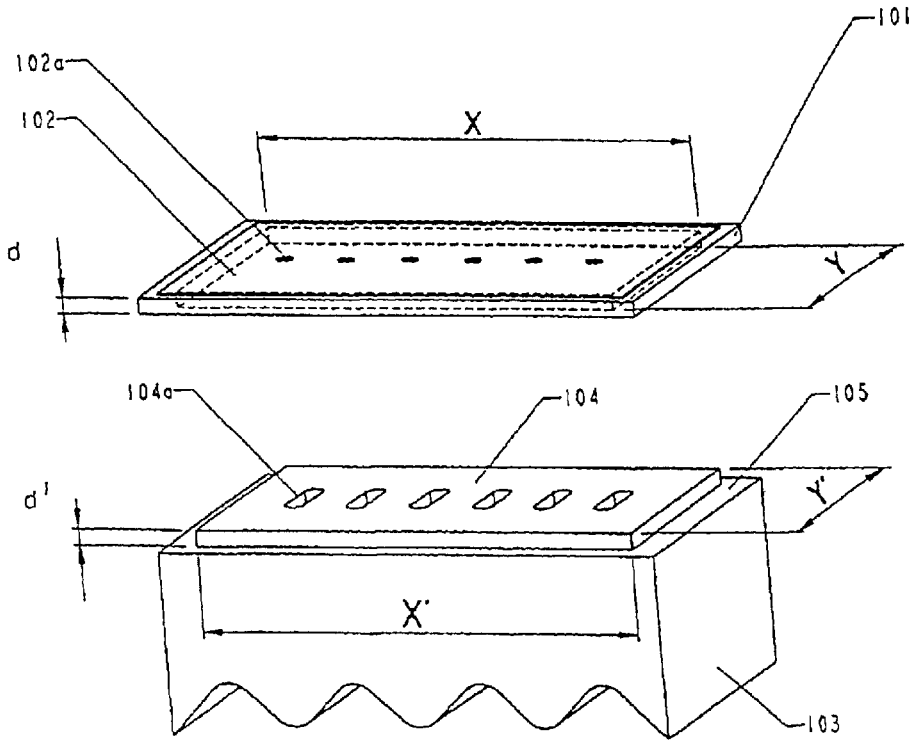
FIG. 1 shows an exploded view of a first embodiment of a releasably attached nozzle plate in accordance with the invention.

In a first embodiment of the invention, as shown in FIG. 1, the nozzle plate is attached to a frame. The frame and/or the nozzle plate are releasably attached to the body. The frame 101 has a thickness d and inner dimensions X and Y and is provided with a nozzle plate 102 with nozzles 102*a*. The body 103 is, on the side of the surface 104 where the channels 104*a* for providing ink terminate—this surface is called the "channel termination surface"—machined so that the channel termination surface has lowered edges 105 and that the remainder of said surface is elevated above those edges to a thickness d' chosen so that $d' \leqq d$. Preferably $d'=d$ so that the nozzle plate attached to the frame rests in contact on the remainder of the channel termination surface. This remainder of the channel termination surface has dimensions X' and Y' chosen so that X'≦X and Y'≦Y. Preferably X' and Y' are equal to the inner dimensions X and Y of the frame so that the frame fits snugly over the remainder of the channel termination surface. In this implementation, although registration marks on the channel termination surface can be useful to help the registration of the nozzle plate, these marks are not strictly necessary, since due to the fit of the frame over the elevated part of the channel termination surface, the nozzles are registered with the exits of the ink channels in the channel termination surface.

Figure 2:
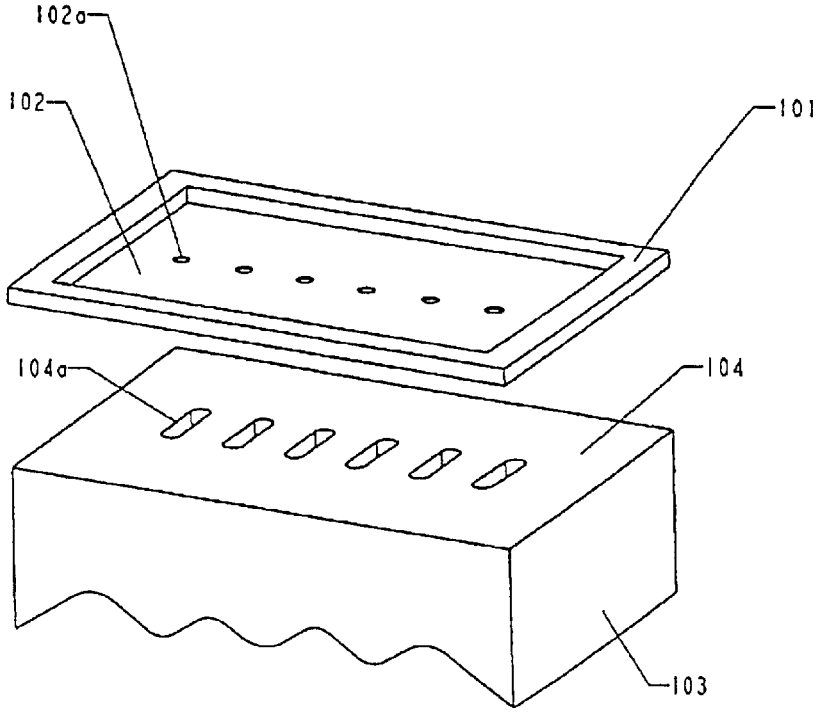
FIG. 2 shows an exploded view of a second embodiment of a releasably attached nozzle plate in accordance with the invention.

In a second embodiment of the invention, as shown in FIG. 2, the nozzle plate is attached to a frame and the frame and/or the nozzle plate are releasably attached to the body, as in the first embodiment. However, in the second embodiment the channel termination surface 104 is not machined and is simply kept flat. The frame 101 carrying the nozzle plate 102 is placed on the flat channel termination surface 104 with the nozzle plate 102 positioned between the frame and the channel termination surface and then the frame is fixed to the body 103 of the droplet deposition apparatus. In this case it is preferred that the body carries at the channel termination surface at least one registration mark, so that the nozzles in the nozzle plate can easily be brought in register with the openings of the channels in the channel termination surface.

In both the first and the second embodiment of the invention, the frame carrying the nozzle plate can be made from any material known in the art, it can be made of stainless steel or of another metal (e.g. copper, aluminum, nickel, etc), it can be made of rigid plastic (e.g. polyvinylchloride, polyurethane, polycarbonate, etc.).

In a third embodiment of the invention, the nozzle plate is micro injection molded. The technique of micro injection molding is well known and makes it possible to manufacture parts with dimensions on micrometer scale with excellent control of tolerances and reproducibility. This technique makes it also possible to use virtually any polymer known in the art to manufacture the nozzle plate; e.g. thermoplastics, fiber reinforced thermoplastics, thermosetting plastics and elastomers can be used for producing a nozzle plate for use in a multi-channel droplet deposition apparatus according to this invention. By micro injection molding it is possible to produce "mini nozzle plates" that can be combined together for making one large nozzle plate. The advantage of this system is that, when a nozzle is defect, only the "mini nozzle plate" carrying that nozzle has to be replaced.

Figure 3:
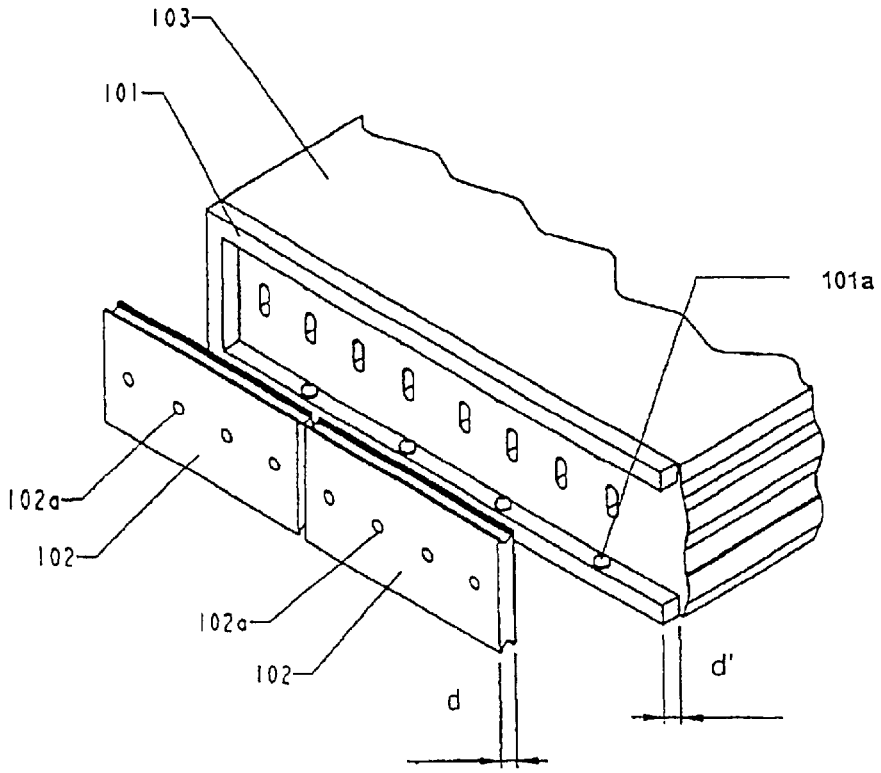
FIG. 3 shows an exploded view of a second embodiment of a releasably attached nozzle plate in accordance with the invention.

In FIG. 3 such an apparatus is schematically shown. It shows two "mini nozzle plates" 102 that each have four nozzles 102*a*. These "mini nozzle plates" may be formed so as to fit tightly in a frame 101 that is attached to the body 103 of the droplet ejection apparatus at the channel termination surface 104. The "mini nozzle plates" may have over their length a notch and the frame may have springs 101*a* that fit in the notch when the "mini nozzle plates" are pressed in the frame, so as to keep the "mini nozzle plates" secured in the frame. The "mini nozzle plates" may also be equipped with a grip for easy removal.

The number of nozzles in a "mini nozzle plate" depends on the diameter of the nozzles and the nozzle pitch and on the dimension of the "mini nozzle plate" that is desired for easy handling of the "mini nozzle plates". So, e.g., when a nozzle plate with nozzles having a diameter of 100 μm and a pitch of 200 μm is to be made up with "mini nozzle plates", then it can be beneficial to produce, by micro injection molding, "mini nozzle plates" having something like 25 nozzles in a row, which gives a length of about 0.5 cm for every "mini nozzle plate".

The frame 101 wherein the "mini nozzle plates" are placed and/or the nozzle plate 102 are releasably attached to the body 103, as in the first and in the second embodiments. The frame 101 can also be an integral part of the body 103; in this case the channel termination surface is preferably machined so as to have raised edges that then act as the frame for accepting the "mini nozzle plates". In case the frame is releasably attached to the body, it is easier to replace a "mini nozzle plate" than when the frame is an integral part of the body.

In a fourth embodiment of the invention, no special frame is used to carry the nozzle plate. The nozzle plate can either be a "normal" nozzle plate or a "mini nozzle plate". The nozzle plate, that is preferably made of a polymeric sheet with through holes, is releasably attached to the body 103.

In all embodiments described above, the nozzle plate 102 is preferably made of a material that is a chemically resistant ablatable polymer in sheet form, such as polyester, polyether ether ketone or, which is more preferred, polyimide. Polyimide has the advantage that it has a relatively low thermal expansion coefficient and that it is obtainable in sheet form in a particularly flat condition approximating to an optically flat or mirror surface, appropriate for the nozzle exit face. The nozzle plate can also be coated with a low energy surface coating as disclosed in U.S. Pat. No. 5,010,356. The nozzle plate can also be made of silicon.

The nozzles 102*a* can be made in the nozzle plate using any technique known in the art. A possible way to make the nozzles, when these have a diameter of about 300 μm, is rigorous mechanical drilling. For smaller aperture diameters (i.e. below 200 μm, preferably below 100 μm) laser burning is a fabrication process that is well known to those skilled in the art. For the production of nozzles with small diameter, plasma etching is a method of choice, since by plasma etching nozzles with very smooth walls can be produced. This smoothness of the walls helps to avoid clogging of the nozzles and misdirection of the ink. A very good method for making the nozzles is the combination laser/plasma etching wherein a method is used of proper focusing and positioning the laser beam whereby an aperture with smaller diameter (than the one finally needed in the nozzle) is burned through the nozzle plate material. After this initial laser burning a plasma etching step follows to enlarge the diameter of the laser burned aperture to the final diameter of the nozzle.

Now, it will be described how a nozzle plate is releasably attached in accordance with the invention.

In general, the nozzle plate can releasably be fastened to the body by mechanical means, such as screws, clamps, a kind of press-studs, coils springs, etc. It can also be releasably fastened by magnetic forces, e.g. by using a magnetic material to form the frame, or by incorporating permanent magnets either in the frame or in the body or in both.

In accordance with the invention, a nozzle plate is releasably attached to the printhead body by using an adhesive layer so that upon detaching the nozzle plate from the channel termination surface, there is an adhesive break between the adhesive layer and the channel termination surface and there is no cohesive break within the adhesive layer. When a force is exerted substantially perpendicularly to the bound nozzle plate, there is no movement or displacement of the nozzle plate, but upon peeling by a shear force the nozzle plate is removed from the printhead body together with the adhesive layer. To obtain this effect, a proper combination of three materials must be used, i.e. the adhesive and the materials of the two parts that are attached to each other by the adhesive. These two parts are respectively the nozzle plate and the channel termination surface if no intermediate layers are used; see further below for the presence of intermediate layers.

The nozzle plate is preferably made of polyimide. Some other suitable materials were already mentioned above. The channel termination surface is preferably made of PZT, which is a piezoelectric ceramic material. Other possible materials for the channel termination surface include other ceramic materials than PZT, stainless steel and sintered aluminum oxide $Al_2O_3$. The adhesive is preferably a so called "removable" pressure sensitive adhesive, although certain thermo adhesives can be used as well. Pressure sensitive adhesives that are more or less suitable, depending a.o. on the materials of the two parts that are to be attached to each other by the adhesive, include: Acronal 4D, Acronal 50 D, Acronal DS 3454, Acronal 35 D, Acronal LA 449S, all from BASF; Adhesive 13D and Adhesive 51R, both from CYG, France; Primal EP-6120 and Primal PS-61D, both from Rohm & Haas; SE4367, SE1390, SE4397, all from H. B. Fuller, United Kingdom; R300, R361, R397, all from Rhône-Poulenc.

Between the nozzle plate and the channel termination surface, several kinds of intermediate layers may be used.

A first kind of intermediate layer is a subbing layer that may be applied to the nozzle plate in order to enhance the adherence between the nozzle plate and the adhesive. First the subbing layer is applied to the nozzle plate and subsequently the adhesive layer is applied to the subbing layer. Suitable subbing layers can be determined by experimentation for a given kind of nozzle plate and adhesive.

A second kind of intermediate layer is a release-enhancing layer that may be applied to the channel termination surface in order to decrease the adherence between the channel termination surface and the adhesive. Suitable release-enhancing products depend on the kind of channel termination surface and adhesive and may include products such as Polywax 1000 (polyethylene wax) from Bareco div., Vydax 1000 [polytetrafluoroethylene (PTFE)] from duPont, Plexigum M345 (polymethyl methacrylate) from Rohm & Haas.

A third kind of intermediate layer is an intermediate structure, such as a molybdenum plate having orifices, positioned between the channel termination surface and the nozzle plate. In this case, the nozzle plate is preferably releasably adhered, as described above, to the intermediate structure. However, the intermediate structure may also be releasably adhered to the channel termination surface. In both cases, there is an adhesive layer between the nozzle plate and the channel termination surface, positioned either between the nozzle plate and the intermediate structure, or between the intermediate structure and the channel termination surface, or—in which case there are two adhesive layers—even at both positions.

It is preferred that the adhesive layer is applied, e.g. by coating, to the nozzle plate (or to the intermediate layer(s) applied already to the nozzle plate) and not to the channel termination surface. The nozzle plate, including the adhesive layer, is then adhered to the channel termination surface.

The nozzle plate may have corrugations as disclosed in U.S. Pat. No. 5,855,713. In this case, micro-cavities and bonding surface lands are formed together in the form of corrugations. The corrugations are typically 2–4 $\mu$m deep and of spacing or wavelength 10–20 $\mu$m. The lands left between the micro-cavities have preferably a width in contact with the channel termination surface of between 0.05 times and 0.25 times the width of the micro-cavities. By controlling the formulation of the adhesive and the relative dimensions of the lands between the micro-cavities, the bonding strength of the nozzle plate can be adjusted so as to have a strong adhesion when the force is perpendicular to the plane of the nozzle plate (this force is exerted mainly by the ink pressure in the channels reaching the nozzle plate) and a sufficiently weak adhesion when a peeling force is exerted to separate the nozzle plate from the body.

All kinds of intermediate layers, as well as corrugations, may be mutually combined and may be combined with the embodiments having different mechanical configurations disclosed above.

EXAMPLE 1 nozzle plate: Kapton film (Kapton is a Trademark of DuPont; Kapton is a polyimide), type 200 HN, nominal thickness 50.8 $\mu$m channel termination surface: PZT adhesive: Acronal 50D (from BASF), concentration 50% (this adhesive is an acrylate-based, water based latex)

The adhesive was applied to the Kapton™ film by means of a 20 $\mu$m coating knife. After drying, the thickness of the adhesive layer was about 10 $\mu$m. The Kapton™ film with the coated adhesive layer was adhered under pressure to the channel termination surface (using a Codor Lamipacker LPP650; the laminating rolls were set up to an impression of 1 mm to create enough pressure between the two rolls)

Forty-eight hours after the adherence, the nozzle plate was peeled from the channel termination surface. The adhesive was completely removed from the channel termination surface, together with the nozzle plate. No residue of adhesive remained on the channel termination surface.

EXAMPLES 2 TO 4

The following adhesives were used:

example 2: Acronal 35D (from BASF), concentration=50% example 3: Robond PS-8120 (from Rohm & Haas), concentration=54–55% example 4: Robond PS-8111 (from Rohm & Haas), concentration=56–57%

Otherwise, the tests were identical to Example 1. The same test results as in Example 1 were obtained.

EXAMPLES 5 TO 8

The PZT was replaced by aluminum oxide $Al_2O_3$; otherwise, the tests were identical to Examples 1–4. The same test results as in Example 1 were obtained.

In piezo ink jet printers wherein ink channels—with walls that can exert piezo pressure on the ink in the channels—terminate in a common channel termination surface, it is very beneficial to have a nozzle plate that is releasably attached, in accordance with the invention, to the channel termination surface. This however does not mean that in ink jet printheads wherein ink ejection proceeds by, e.g., acoustic waves, bubble generation, thermal expansions, etc. it would not be beneficial to have easily replaceable nozzle plates as disclosed above. In fact, in every ink jet printhead the possibility to replace only the nozzle plate and not the whole printhead is a desirable feature, especially in those ink jet printers—independently of the way of ink ejection—wherein the printhead has a wide array, even a page wide array of nozzles. The invention can not only be applied to piezo ink jet printheads but to all kinds of droplet deposition apparatus.

Having described in detail preferred embodiments of the current invention, it will now be apparent to those skilled in the art that numerous modifications can be made therein without departing from the scope of the invention as defined in the appending claims.

LIST OF REFERENCE SIGNS

101 Frame
101*a* Springs
102 Nozzle plate or "mini nozzle plate"
102*a* Nozzles
103 Body
104 Channel termination surface
104*a* Channels
105 Lowered edges

What is claimed is:

1. A multi-channel droplet deposition apparatus comprising a body having a plurality of channels terminating in a common channel termination surface and a nozzle plate, releasably attached to said channel termination surface, said nozzle plate having nozzles for selectively ejecting liquid drops originating from said plurality of channels, wherein said nozzle plate is releasably attached to said channel termination surface by an adhesive layer, said adhesive layer being adapted so that, upon detaching said nozzle plate from said channel termination surface, there is an adhesive break between said adhesive layer and said channel termination surface without cohesive break within said adhesive layer.

2. A multi-channel droplet deposition apparatus according to claim 1 wherein said nozzle plate has through holes and is placed on said body at said channel termination surface, thus providing said droplet ejection nozzles.

3. A multi-channel droplet deposition apparatus according to claim 1 further comprising a first intermediate layer between said adhesive layer and said nozzle plate.

4. A multi-channel droplet deposition apparatus according to claim 3 further comprising a second intermediate layer between said adhesive layer and said channel termination surface.

5. A multi-channel droplet deposition apparatus according to claim 1 wherein said nozzle plate is made of a polymeric sheet material and is attached to a frame for carrying the nozzle plate.

6. A multi-channel droplet deposition apparatus according to claim 1 wherein said body further comprises registration marks for placing said nozzle plate in register with said plurality of channels onto said channel termination surface.

7. A multi-channel droplet deposition apparatus according to claim 1 wherein said nozzle plate comprises a plurality of mini nozzle plates.

8. A multi-channel droplet deposition apparatus according to claim 7 wherein said plurality of mini nozzle plates are releasably fixed in a frame.

9. A multi-channel droplet deposition apparatus according to claim 1, wherein said multi-channel droplet deposition apparatus is a printhead structure for use in ink-jet printing.

10. A multi-channel droplet deposition apparatus according to claim 1 wherein said plurality of channels include means to eject ink at said channel termination surface by piezo pressure.

* * * * *